US009896894B2

(12) United States Patent
Barison et al.

(10) Patent No.: US 9,896,894 B2
(45) Date of Patent: Feb. 20, 2018

(54) DRILLING AND GROUTING METHOD AND APPARATUS

(71) Applicant: SOLETANCHE FREYSSINET, Rueil Malmaison (FR)

(72) Inventors: Luca Barison, Cuddy, PA (US); Larry Goff, Cuddy, PA (US); Laurent Lefebvre, Cuddy, PA (US); Steve England, Hamilton (CA); Stefano Gabaldo, Hamilton (CA); Michael Justason, Hamilton (CA)

(73) Assignee: SOLETANCHE FREYSSINET, Rueil Malmaison (FR)

( * ) Notice: Subject to any disclaimer, the term of this patent is extended or adjusted under 35 U.S.C. 154(b) by 299 days.

(21) Appl. No.: 14/438,874

(22) PCT Filed: Dec. 21, 2012

(86) PCT No.: PCT/EP2012/076766

§ 371 (c)(1),
(2) Date: Apr. 27, 2015

(87) PCT Pub. No.: WO2014/067590

PCT Pub. Date: May 8, 2014

(65) Prior Publication Data

US 2015/0252639 A1 Sep. 10, 2015

Related U.S. Application Data

(60) Provisional application No. 61/720,492, filed on Oct. 31, 2012.

(51) Int. Cl.
*E21B 21/12* (2006.01)
*E02D 5/46* (2006.01)
(Continued)

(52) U.S. Cl.
CPC ..... *E21B 21/12* (2013.01); *E02D 5/46* (2013.01); *E21B 17/18* (2013.01); *E21B 21/103* (2013.01); *E21B 33/138* (2013.01)

(58) Field of Classification Search
CPC ..... E21B 21/12
See application file for complete search history.

(56) References Cited

U.S. PATENT DOCUMENTS 2,701,122 A * 2/1955 Grable ..... E21B 21/12 175/66
2,786,652 A * 3/1957 Wells ..... E21B 21/12 175/206

(Continued)

FOREIGN PATENT DOCUMENTS

EP 2 463 443 6/2012

OTHER PUBLICATIONS

First Examination Report dated Aug. 31, 2015, New Zealand Application No. 707153, pp. 1-2.

(Continued)

*Primary Examiner* — Robert E Fuller
*Assistant Examiner* — Steven A MacDonald
(74) *Attorney, Agent, or Firm* — MH2 Technology Law Group, LLP

(57) ABSTRACT

A drilling and grouting device comprises a drill string including a hollow elongate outer rod having a central axis and a hollow elongate inner rod located coaxially within said outer rod, wherein a first outer flow path is defined between said inner and outer rod, and a first central flow path is defined inside said inner rod, a drill bit aligned with said inner rod along said central axis and including a second central flow path, and a crossover part interposed between said inner rod and said drill bit along said central axis, which is configured to connect the first central flow path with a (Continued)

second outer flow path surrounding the drill bit to form a main path and to connect said first outer flow path with said second central flow path to form a secondary path. Also disclosed are systems and methods that include and use the device.

12 Claims, 10 Drawing Sheets

(51) Int. Cl.

| | |
|---|---|
| ***E21B 17/18*** | (2006.01) |
| ***E21B 21/10*** | (2006.01) |
| ***E21B 33/138*** | (2006.01) |

(56) References Cited

U.S. PATENT DOCUMENTS

| | | | | |
|---|---|---|---|---|
| 3,236,319 | A * | 2/1966 | Brown | E21B 10/18 175/243 |
| 3,259,198 | A | 7/1966 | Montgomery et al. | |
| 3,268,017 | A * | 8/1966 | Yarbrough | E21B 21/08 175/210 |
| 3,638,742 | A * | 2/1972 | Wallace | E21B 21/12 175/215 |
| 4,080,091 | A * | 3/1978 | Hollingshead | E21B 10/18 175/340 |
| 2011/0214920 | A1 | 9/2011 | Vail, III et al. | |

OTHER PUBLICATIONS

International Search Report dated Sep. 17, 2013 from International Application No. PCT/EP2012/076766, pp. 1-3.

* cited by examiner

VALVE 'A' - OPEN
VALVE 'B' - CLOSED
VALVE 'C' - CLOSED
VALVE 'D' - OPEN

VALVE 'A' - CLOSED
VALVE 'B' - CLOSED
VALVE 'C' - OPEN
VALVE 'D' - CLOSED

VALVE 'A' - CLOSED
VALVE 'B' - OPEN
VALVE 'C' - CLOSED
VALVE 'D' - CLOSED

VALVE 'A' - OPEN
VALVE 'B' - CLOSED
VALVE 'C' - OPEN
VALVE 'D' - OPEN

DRILLING AND GROUTING METHOD AND APPARATUS

CROSS-REFERENCE TO RELATED APPLICATIONS

This application is a U.S. National Stage application of International Appl. No. PCT/EP2012/076766 filed 21 Dec. 2012, which claims priority to U.S. Provisional Application No. 61/720,492 filed 31 Oct. 2012, the entire disclosures of which are hereby incorporated by reference in their entireties.

FIELD OF THE DISCLOSURE

The present disclosure generally relates to the field of ground drilling and grouting, and more particularly to reverse circulation rotary drilling.

More specifically, the present disclosure concerns a drilling and grouting device, a drilling and grouting machine comprising such drilling and grouting device, and a drilling and grouting method using such machine.

The apparatus and method according to the present disclosure are particularly intended to improve poor-quality ground to facilitate tunnelling or excavating. The apparatus and method may also be used in dam rehabilitation or remedial work on or around dams among other things. Due to its versatility, the apparatus can be utilized when drilling directly from ground level or from a barge on off shore applications.

BACKGROUND OF THE DISCLOSURE

Reverse Circulation rotary drilling, also known as "RC Drilling" or "Dual Wall Drilling", has been used to sink boreholes into the ground for example, for mineral exploration.

FIG. 13 shows an exemplary device for such Reverse Circulation rotary drilling, employing a dual wall pipe 122 comprising an outer drill rod 124 with an inner rod 126 located inside said outer drill rod 124 and provided with a drill bit 140 at its distal end.

A drilling fluid, which may be high pressure air or water, is passed in the outer flow path defined between the outer and inner rods 124, 126, down to the drill bit 140. Once the drilling fluid hits said drill bit, the cuttings mixed with the said fluid are forced up to the center of the bit and back up the inner tube 126. Cuttings are so returned to the surface and collected for later use.

This kind of tooling, however, is not appropriate for grouting operations.

Injection of the grout through the annular space between the outer and inner rod is undesirable, particularly when the grout has a high viscosity and is of low mobility. Due to the large 'wetted-perimeter' of this annular space, there is a high risk that the grout may plug the device.

Injection of the grout through the inner rod can damage and/or destroy the drill bit. Also, the drill bit prevents free flow of grout into the drill hole, particularly when the grout is of low mobility.

Taking the inner rod and the drill bit out of the outer drill rod, to allow for the free flow of grout into the outer drill rod is time-consuming and presents problems when drilling and grouting operations must happen very quickly. Likewise, removing the dual wall pipe for introducing a separate injection device in the drill hole also necessitates much time and additional equipment.

SUMMARY OF THE DISCLOSURE

In view of the foregoing, there is a need for a method and apparatus which enable both drilling the ground and injecting grout into the obtained borehole efficiently, in particular quickly and easily while preventing plugging. It is an object of the present disclosure to provide such method and apparatus.

According to embodiments of the present disclosure, there is provided a drilling and grouting device, comprising a drill string including a hollow elongate outer rod having a central axis and a hollow elongate inner rod located coaxially within said outer rod, wherein a first outer flow path is defined between said inner and said outer rod, and a first central flow path is defined inside said inner rod, a drill bit aligned with said inner rod along said central axis and including a second central flow path, and a crossover part interposed between said inner rod and said drill bit along said central axis, said crossover part being configured to connect the first central flow path with a second outer flow path surrounding the drill bit to form a main path and to connect said first outer flow path with said second central flow path to form a secondary path.

The present disclosure thus provides a single device suitable for drilling the ground and subsequently injecting grout into the ground, without removing the device between the drilling and grouting stages.

Drilling fluid, usually air, water or a mix of both, injected in the annular space between the outer and inner rod is deviated by the crossover part towards the inside of the drill bit.

When entering into the drill hole, drilling fluid is mixed with the cuttings produced by rotation of the drill bit. In a normal case, in which the ground is relatively impermeable, the mix of cuttings and drilling fluid is returned back to the surface by being pushed by drilling fluid constantly entering the drill hole. The mix of cuttings and fluid enters the second outer flow path surrounding the drill bit and moves upwards through the crossover and through the first central flow path, generally towards a waste-collection tank.

After drilling has been completed, grout is pumped down though the main path. It passes through the first central flow path, crosses-over and flows around the drill bit and into the ground formation.

Rates of drilling and grouting production can be greatly increased over conventional drilling methods.

Another benefit of the disclosure is that during the grouting phase, the grout is separated from the environment with a 'double-protection' system. The grout or the cuttings flowing through the inner rod of the drill string are 'double-protected' in that they do not flow into the surrounding ground or sea even if the inner or the outer rod breaks. This might be important in situations where the system drills through contaminants, or in environmentally sensitive areas.

Moreover, both cuttings and grout flow through the inner rod, which circular section is much more adapted to avoid plugs and facilitate the flow than the annular space defined between the outer and the inner rod.

It is further to be noted that the drilling and grouting device according to the present disclosure can be used on projects where inclined drilling is required. It could even be used in horizontal drilling.

As an example, the application of this type of drilling for remedial drilling/grouting work on, and surrounding, dams is particularly advantageous.

Generally, the crossover part comprises at least one main connecting duct for connecting the first central flow path with the outside of the drill bit and at least one secondary connecting duct for connecting the first outer flow path with the second central flow path.

Advantageously, the crossover part comprises at least two main connecting ducts, regularly distributed circumferentially.

In the same manner, the crossover part preferably comprises at least two secondary connecting ducts, regularly distributed circumferentially.

As indicated above, in a case where the ground is relatively impermeable, the cuttings are forced to move upwards in the main path by being pushed by the drilling fluid.

According embodiments of the disclosure, a bypass is provided between the secondary path and the main path for deviating a part of the fluid circulating through said secondary path towards said main path. For example, such bypass may be provided between the secondary path and the second outer flow path for deviating a part of the fluid circulating through said secondary path towards said second outer flow path. This is particularly adapted to cases where the ground is moderately permeable, that is, a part of the drilling fluid moves upwards with the cuttings, but not sufficiently to avoid plugging of the cuttings in the main path. The bypass ensures that at least a predetermined amount of water is not lost in the ground but mixed with the cuttings which enter the second outer flow path.

The bypass can be provided with a check valve.

Also the drill bit is advantageously provided with a check valve. Such check valve can prevent the flow of grout up into the crossover part and into the annular space between the outer and inner rod, that is, into the first outer flow path.

The crossover part and the hollow elongate outer rod are adapted to rotate as a single unit.

According to another aspect of the disclosure, there is provided a drilling and grouting machine, comprising a drilling and grouting device having a drill string including a hollow elongate outer rod having a central axis and a hollow elongate inner rod located coaxially within said outer rod, wherein a first outer flow path is defined between said inner and said outer rod, and a first central flow path is defined inside said inner rod, a drill bit aligned with said inner rod along said central axis and including a second central flow path, and a crossover part interposed between said inner rod and said drill bit along said central axis, said crossover part being configured to connect the first central flow path with a second outer flow path surrounding the drill bit to form a main path and to connect said first outer flow path with said second central flow path to form a secondary path;

a first moving device for rotating said drilling and grouting device about its central axis;

a second moving device for vertically moving said drilling and grouting device in a direction parallel to the central axis;

a drilling fluid supplying device connected to the secondary path for supplying said secondary path with drilling fluid; and a grout supplying device connected to the main path for supplying said main path with grout.

According to still another aspect of the disclosure, there is provided a drilling and grouting method, comprising the steps of providing a drilling and grouting machine comprising a drilling and grouting device having a drill string including a hollow elongate outer rod having a central axis and a hollow elongate inner rod located coaxially within said outer rod, wherein a first outer flow path is defined between said inner and said outer rod, and a first central flow path is defined inside said inner rod, a drill bit aligned with said inner rod along said central axis and including a second central flow path, and a crossover part interposed between said inner rod and said drill bit along said central axis, said crossover part being configured to connect the first central flow path with a second outer flow path surrounding the drill bit to form a main path and to connect said first outer flow path with said second central flow path to form a secondary path a first moving device for rotating said drilling and grouting device about its central axis; a second moving device for vertically moving said drilling and grouting device in a direction parallel to the central axis; a drilling fluid supplying device connected to the secondary path for supplying said secondary path with drilling fluid; a grout supplying device connected to the main path for supplying said main path with grout, rotating said drilling and grouting device about its central axis, moving said rotating device downwardly in the ground, and controlling said drilling fluid supplying device for supplying the secondary path with drilling fluid, collecting the cuttings moved upwards through the main path, and controlling said grout supplying device for supplying the main path with grout, to inject grout in the ground.

In some cases, when the ground is very permeable, the drilling fluid can be lost in the ground, and may not move upwards with the cuttings through the main path. Consequently, part of the cuttings is left in the ground. In some cases, the circulation of drilling fluid (downwards through the secondary path and then upwards, mixed with the cuttings, through the main path) is stopped when the main path is already partially or fully filled with cuttings. Attempts to pump grout back down the main path may then lead to plugging of the drill bit and the crossover part.

According to the disclosure, by injecting drilling fluid both through the main and the secondary paths during drilling, plugs of cuttings in the main path may be avoided.

According to some embodiments, the method may comprise bypassing part of the drilling fluid supplied to the secondary path to said second outer flow path. As indicated above, this may be particularly advantageous in cases where the ground is moderately permeable, that is, a part of the drilling fluid moves upwards with the cuttings, but not sufficiently to avoid plugging of the cuttings in the main path.

According to some aspects of the disclosure, there is provided a crossover part configured for being assembled to a drill string of a drilling and grouting device including a hollow elongate outer rod and a hollow elongate inner rod located coaxially within said outer rod, said crossover part comprising a central axis and, at one axial end, at least a first centered opening adapted to be connected to said first inner rod and at least a first offset opening adapted to be connected to a flowpath defined between said outer rod and said inner rod, and at its axially opposed end, at least a second centered opening and at least a second offset opening, the first centered opening being connected to the second offset opening and the first offset opening being connected to the second centered opening.

The first centered opening may be connected to the second offset opening by at least one main connecting duct. In the same manner, the first offset opening may be connected to the second centered opening by at least one secondary connecting duct.

It is to be understood that, except in cases of clear incompatibility and unless otherwise stated, features of one embodiment or example described herein can similarly be applied to other embodiments or examples described herein.

Other features and advantages of the disclosure will become apparent from the following detailed description, taken in conjunction with the accompanying drawings, which illustrate, by way of example, the principles of the disclosure.

BRIEF DESCRIPTION OF THE DRAWINGS

In the drawings, like reference signs generally refer to the same parts throughout the different views.

DETAILED DESCRIPTION

The following detailed description refers to the accompanying drawings showing examples of the drilling and grouting device according to the present disclosure. It is intended that these examples be considered as illustrative only, the scope of the disclosure not being limited thereto.

Figure 9:
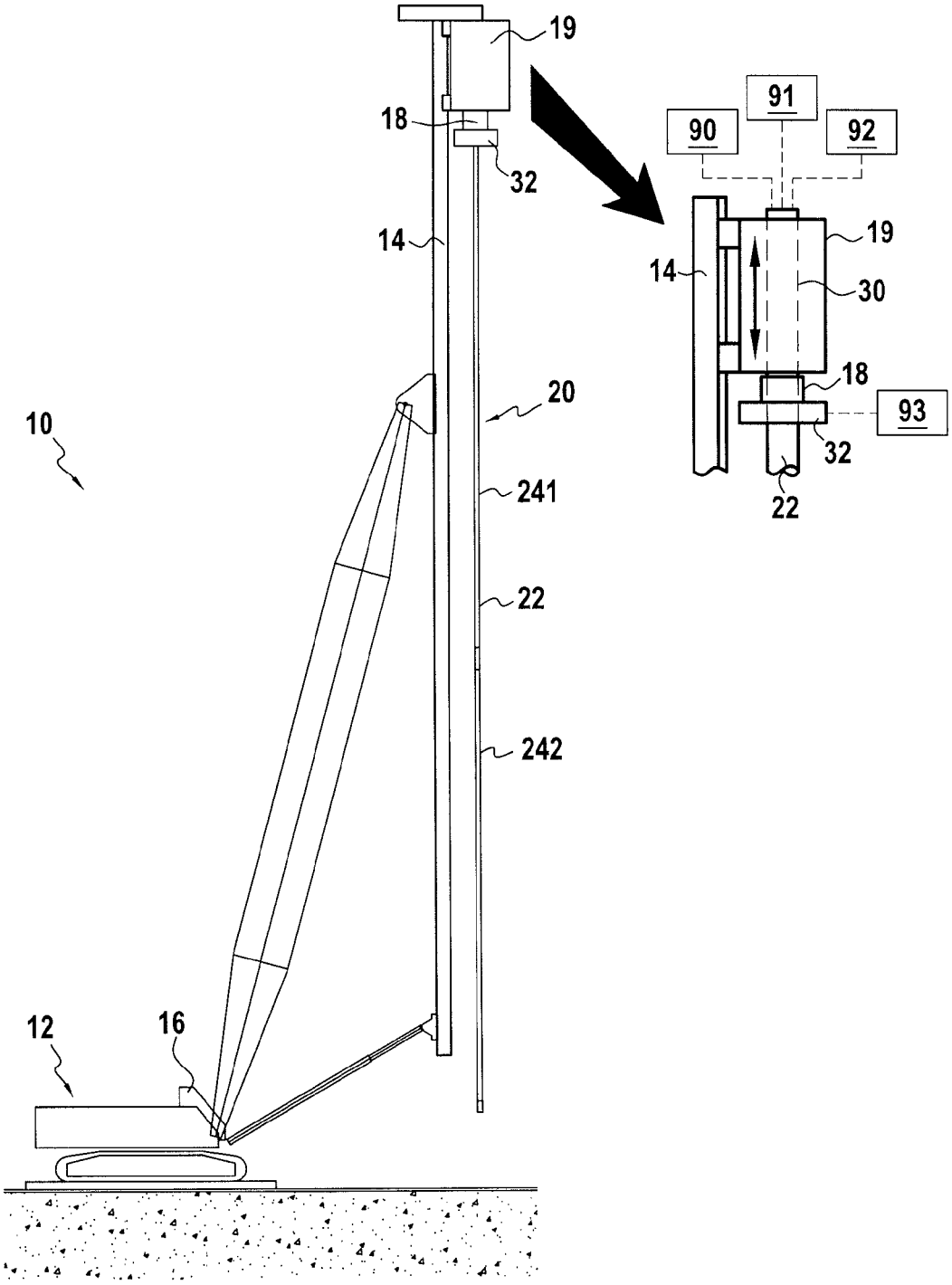
FIG. 9 is a schematic illustration of a drilling and grouting machine according to the present disclosure.

FIG. 9 is a schematic illustration of an exemplary drilling and grouting machine according to the disclosure, for improving and/or sealing the ground.

The drilling machine 10 includes a frame or tracked vehicle 12 which may be disposed on an offshore platform or on land. A drilling mast 14 is mounted on said frame, in an articulated way, as well as other equipment such as a control console 16 of the drilling machine 10.

A carriage 19 slides along the drilling mast 14. Said carriage 19 supports a drill head 18 to which the drilling and grouting device 20 is mounted.

The drilling and grouting device 20, which will be described in more detail hereafter, comprises a drill string 22 composed of a hollow elongate outer rod 24 and a hollow elongate inner rod 26 located coaxially within said outer rod (see FIG. 1).

The drill string 22 is connected to a plurality of supplying or collecting devices 90, 91, 92, 93.

Figure 5:
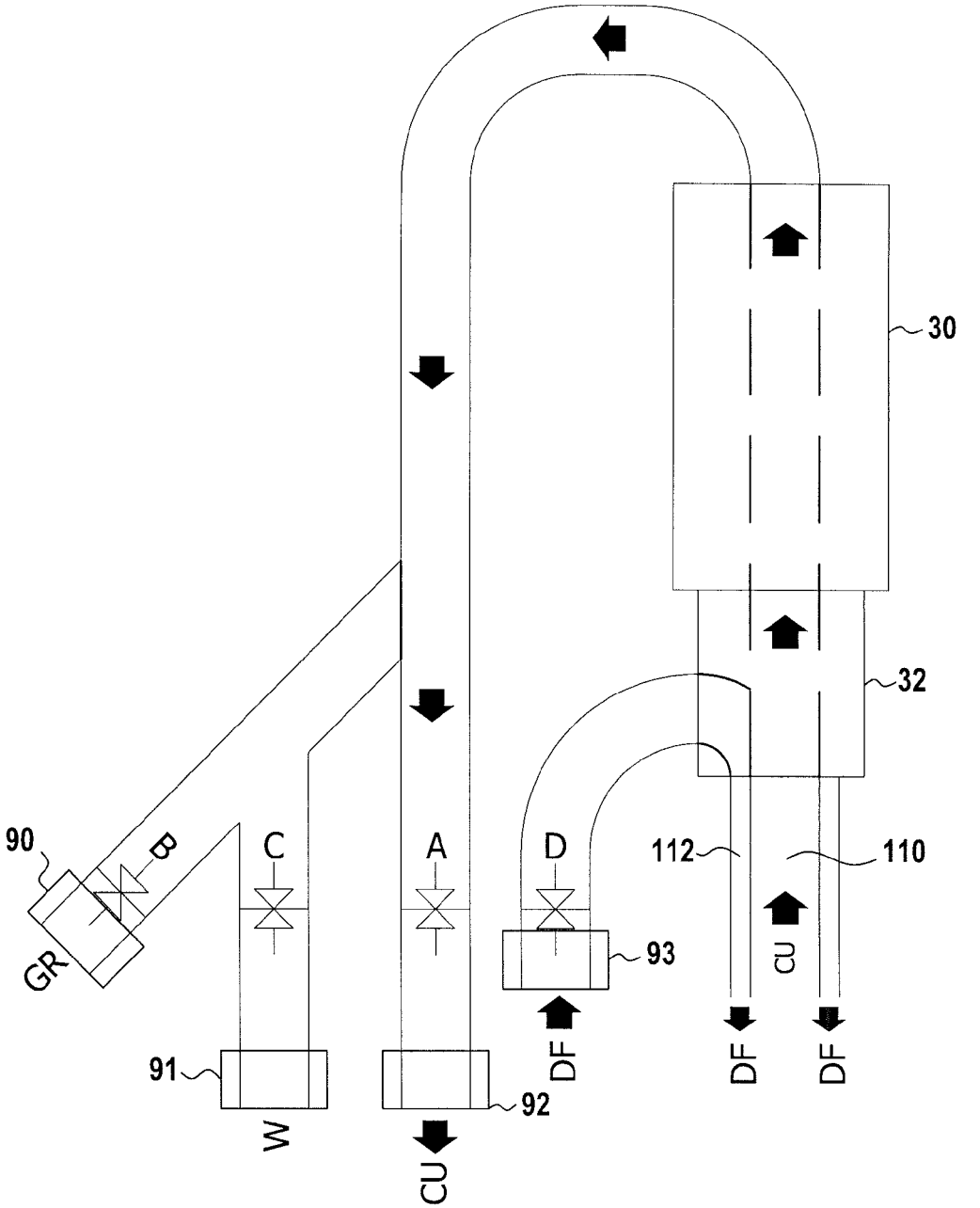
FIG. 5 is a schematic flow diagram during a typical drilling phase.

The annular space defined between the inner and outer rods 24, 26 communicates with a drilling fluid supplying device 93 provided with a controllable valve D (see FIG. 5 for example). A swivel 32 mounted just below the drill head 18 is provided to connect said annular space with said drilling fluid supplying device 93.

The interior of the inner rod 26 communicates with a central pipe 30 connected to the drill head 18 and to a grout supplying device 90, a water supplying device 91 and a discharge device 92. Each of said devices 90, 91, 92 are also provided with controllable valves, respectively C, B, A.

The drilling and grouting device 20 may be rotated about its axis A by means of the drill head 18, and moved jointly with the carriage 19, in a direction parallel to its axis A.

For the following description, the axis A of the drilling and grouting device is the common central axis of the inner and outer rod of the drill string (hereafter also "central axis"). The axial direction corresponds to the direction of said central axis, and a radial direction is a direction perpendicular to said central axis. Similarly, an axial plane is a plane containing the central axis, and a radial plane is a plane perpendicular to said central axis. Finally, unless specified to the contrary, adjectives such as "inner" and "outer" are used relative to a radial direction such that an inner portion (i.e. a radially inner portion) of an element is closer to the central axis than is an outer portion (i.e. the radially outer portion) of the same element.

In the present application, "upstream" and "downstream" are also defined relative to the direction of drilling (from upstream to downstream).

To achieve the desired drilling depth, several assemblies each comprising an outer and an inner drill tube disposed coaxially and linked together, for example by discrete welding points, are attached successively, one to the other. The link between two successive outer tubes 241, 242 (see FIGS. 9 and 10) may preferably be performed by screwing a threaded end of an outer rod 241 to the threaded end of a contiguous outer rod 242. The inner tubes may fit to each other through O-ring press fit for example. When possible/practical, the drilling and grouting device of the disclosure may be used in conjunction with a leader-system long enough to allow for 'single-pass' drilling and grouting, with no need to add or remove each assembly as the drill bit is advanced or withdrawn from the drill-hole. FIG. 1 shows the lower end of the drill string 22 of FIG. 9 and illustrates in more details the drilling and grouting device 20 according to the present disclosure.

The drilling and grouting device 20 comprises, downstream of the drill string 22, disposed along the central axis A, a drill bit 40, for example in the form of a tricone bit, configured to cut the ground.

The drilling and grouting device further comprises a crossover part 50 axially interposed between the drill string 22 and the drill bit 40.

Figure 1:
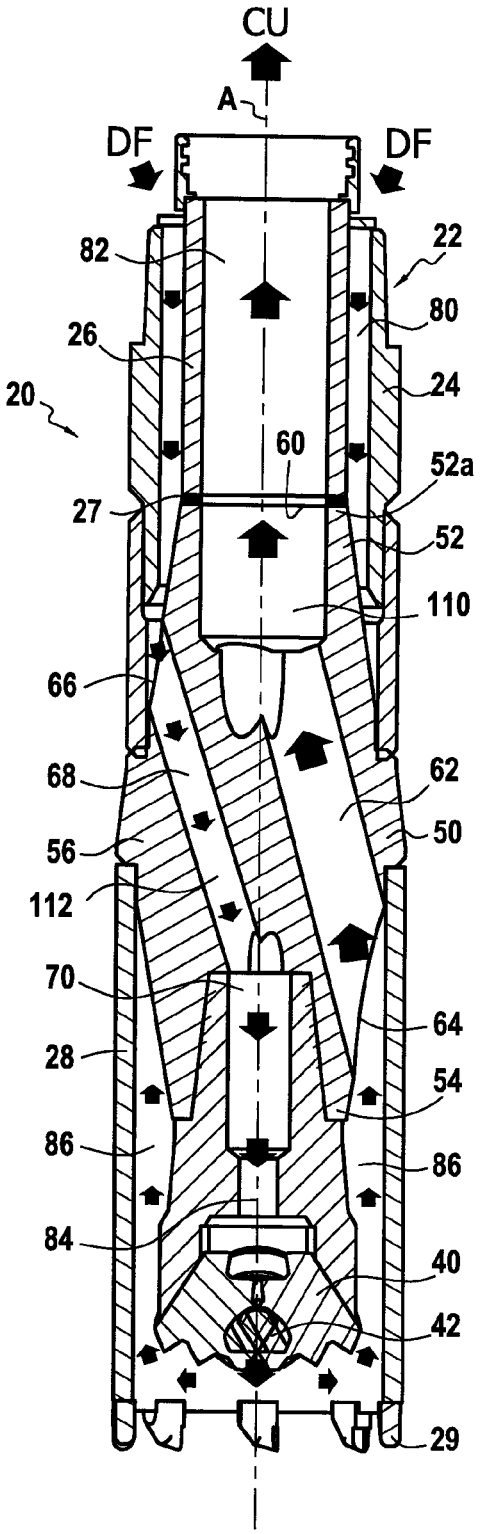
FIG. 1 is a schematic illustration of a drilling and grouting device according to embodiments of the present disclosure, with arrows showing the flow of water and cuttings during the drilling phase.
Figure 2:
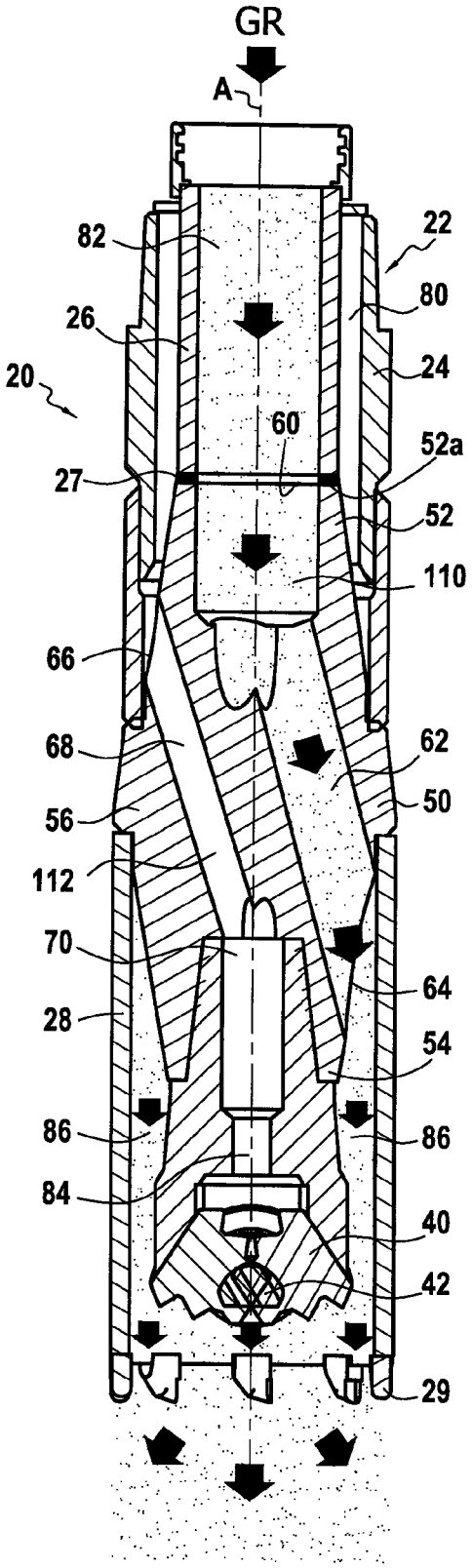
FIG. 2 shows the device of claim 1 during the grouting phase.

In the example shown in FIGS. 1 and 2, the outer rod 24 of the drill string 22 is extended by means of an outer drilling casing 28 threaded thereto and provided with drilling teeth 29 at its end. In other possible configurations, the outer casing 28 may be formed in one piece with the outer rod 24 of the drill string 22.

The outer casing 28 serves to surround the crossover part 50 and, eventually, a part or the entirety of the drill bit 40.

In the example shown in FIGS. 1 and 2, the crossover part 50 has a generally elongated shape, with tapered portions 52, 54 at each end.

In the illustrated example, the crossover part 50 comprises, between those tapered portions, a central part 56 forming a circumferential protrusion. This central part 56 is adapted to cooperate with an aperture formed in the outer casing 28. Crossover part 50 and outer casing 28 may further be fixed by fixing means such as welds, thereby ensuring that they move as a single piece.

Any other configuration or shape allowing that the crossover part has an external maximum diameter at least equal to the inner diameter of the outer casing is also acceptable.

The first upstream end 52*a* of the crossover part 50 is connected to the lower end of the inner rod 26 by O-ring press fit connections 27 for example.

More generally, the system according to the present disclosure advantageously uses a drill string 22 with threaded connections from outer-tubes to outer-tubes (for torque) and a built-in inner rod with 'floating' connections (O-ring press-fit, see o-ring 27 on FIG. 1 for example).

The crossover part 50, connecting the outer rod 24 with the inner rod 26, allows that the torque be transferred from the single drill head 18 to the outer rod 24 only. There is no need to transfer torque to the inner rod 26, no need for a double-head drill, and no need for a duplexing system. The inner rod is less mechanically strained, and therefore less inclined to break.

At its first end 52*a* oriented upstream, the crossover part 50 comprises a first centered opening 60 (here aligned with the central axis A) adapted to be connected to the first inner rod 26 of the drill string 22. This first centered opening 60 is connected by a first oblique connecting duct 62 to an offset opening (hereafter second offset opening) 64 formed on the periphery of the downstream tapered portion 54 of the crossover part 50.

At the periphery of its first upstream tapered portion 52, the crossover part 50 further comprises an offset opening (hereafter first offset opening) 66 connected by a second oblique connecting duct 68 to a second centered opening 70 (here aligned with the central axis A) formed at its opposite end and adapted to be connected to the drill bit 40.

With the above described configuration, the passages formed in the drilling and grouting device 20 according to the present disclosure are as follows:

Upstream from the crossover part 50, a first central flow path 82 is defined inside the inner rod 26, and a first outer flow path 80, usually in the form of an annular area, is delimited by the inner rod 26, the upper part of the crossover part 50, the outer rod 24 and the outer casing 28, and communicates with the first offset opening 66 of the crossover part 50. In the illustrated example, the first outer flow path 80 terminates between the outer casing 28 and the first tapered portion 52 of the crossover part 50.

Downstream from the crossover part 50, a second central flow path 84 is defined inside the drill bit 40. A second outer flow path 86 is further defined radially outside the drill bit, between the outer casing 28 and both the second tapered part 54 of the crossover part 50 and the drill bit 40.

The crossover part 50 allows the first central flow path 82 to be brought into direct communication with the second outer flow path 86. The path comprising the first central flow path 82, the connecting duct(s) of the crossover parts connected thereto and the second outer flow path 86 is referred to, in the present description, as the main path 110. This main path has, on its almost entire length (all along the drill string), a circular section which is optimal for the flow of materials, in particular materials having a moderate or high viscosity.

In the same manner, the crossover part 50 allows the first outer flow path 80 to be brought into direct communication with the second central flow path 84. The path comprising the first outer flow path 80, the connecting duct(s) of the crossover parts connected thereto and the second central flow path 84 is referred to, in the present description, as the secondary path 112. The secondary path 112 has, over almost its entire length (all along the drill string), a general annular section.

The drilling and grouting operations, completed with the above described device, will now be explained in more detail with reference to the figures.

Figure 10:
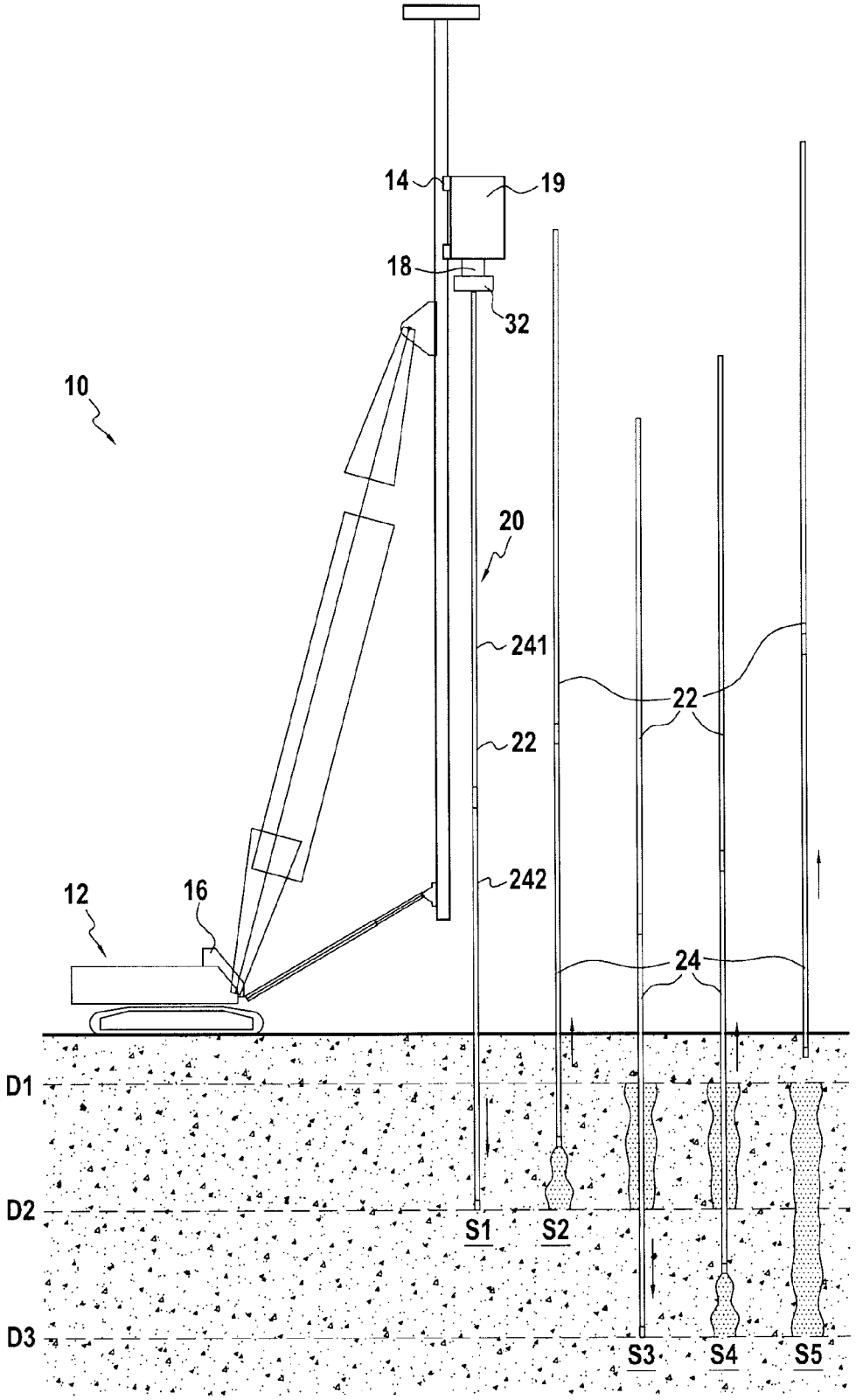
FIG. 10 shows different steps of a drilling and grouting method according to embodiments of the present disclosure.

FIG. 10 schematically illustrates the main steps of a drilling and grouting method according to an embodiment of the present disclosure.

In a first step referenced S1 on FIG. 10, the drill string 22 is rotated jointly with the drill head 18 (see FIG. 10), about its central axis A, and moved downwards along the mast 14, jointly with the carriage 19, until the drill bit reaches a depth D2.

FIG. 1 shows the drilling and grouting device of the disclosure during this typical drilling phase, corresponding to the configuration of FIG. 5.

Drilling fluid (DF), usually water, is injected into the annular area 80 between the outer and inner rod 24, 26, that is, in the secondary path 112, by controlling a valve D of the first drilling fluid supping device. The valve A provided on the cuttings discharge flow path is also open (see the corresponding flow diagram of FIG. 5).

Compressed air can advantageously be added to the water that is pumped into the swivel 32 during the drilling operation. This combination of water and air could aid in the upward 'circulation' of the cuttings—creating a type of air-lift.

Drilling fluid enters the first offset opening(s) of the crossover part 50 and is led by said crossover part 50 towards the center of the drill bit 40, where it helps cooling the drill bit 40 and softening and cutting the ground Drill cuttings mixed with drilling fluid (CU), travel around the outside of the tricone bit 40, crossover and travel upwards through the inner rod 26. Cuttings flow up through the drill head's central passage and are directed down to the discharge device 92, for example a waste-collection tank.

Once the drilling operation has been completed, the drilling and grouting device 20 is slowly moved upwards up to a depth D1 and, simultaneously, the grouting operation is performed.

Figure 6:
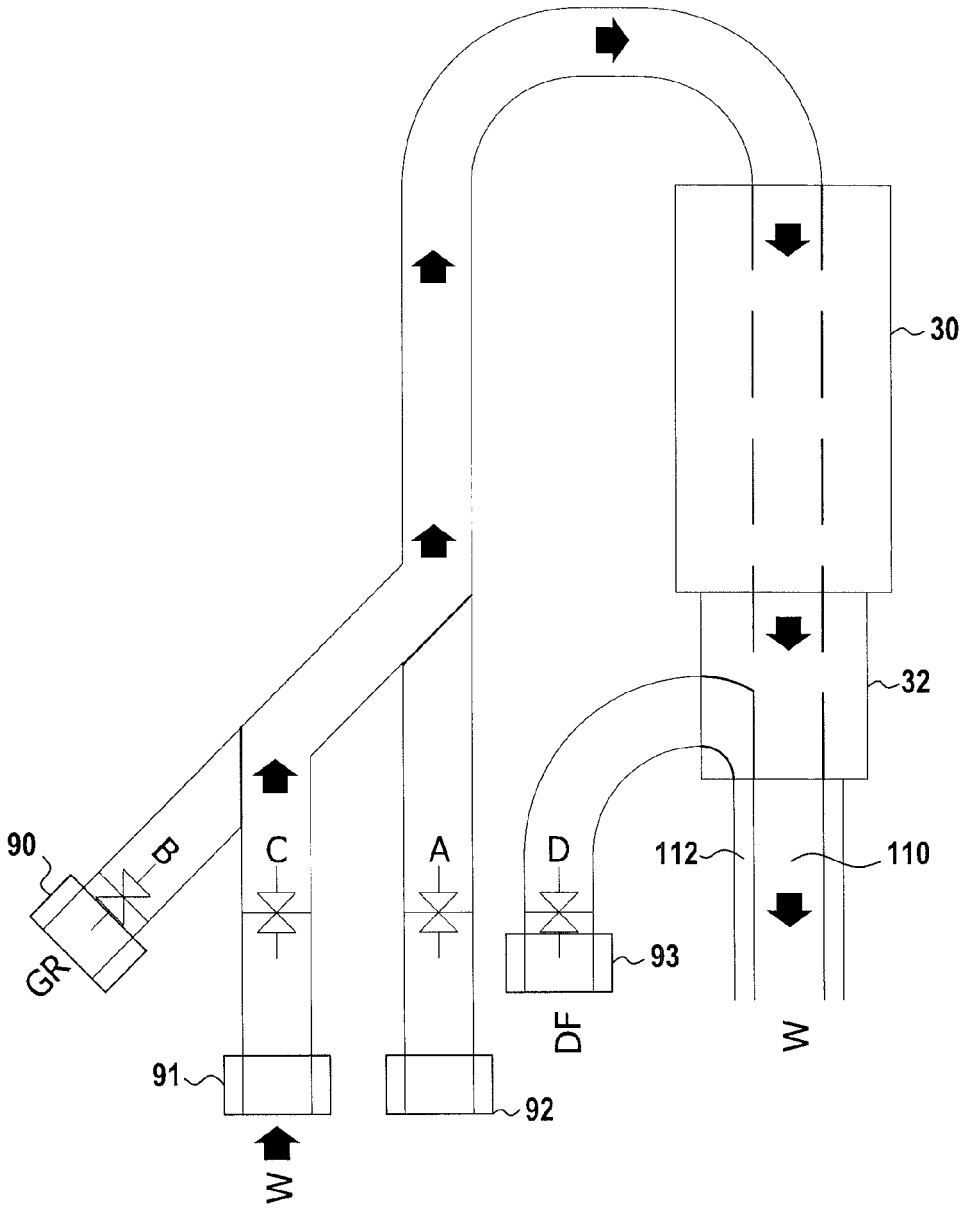
FIG. 6 is a schematic flow diagram during a grout flushing phase.

Before grouting, the main path 110 may be flushed with water (W). As illustrated on FIG. 6, the valve C controlling the water supplying device 91 is open while other valves A, B and D are closed.

The main path 110 is thereby cleaned and the operator can determine that said main path 110 is not plugged and that grouting can be performed.

In a second step S2, grout is then pumped down through the main path 110. It flows through the circular passage 82 of the inner drill rod 26, then crosses-over and flows around the tricone bit 40 and into the ground formation.

Figure 7:
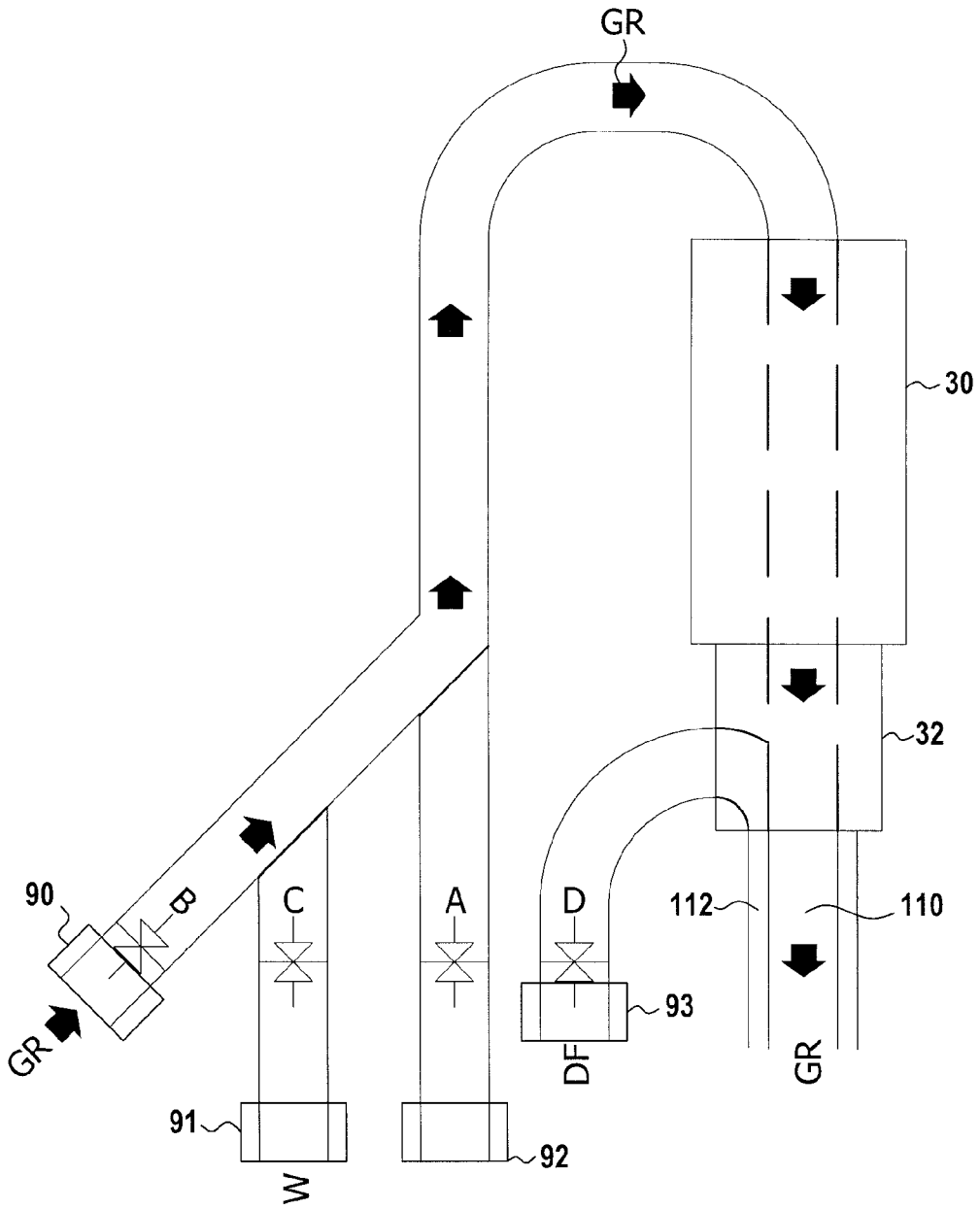
FIG. 7 is a schematic flow diagram during a grouting phase.

As shown in FIG. 7, the valve B of the grout supplying device 90 is open while the other valves A, C and D are closed.

A check-valve 42 is installed inside the tri-cone bit 40 for preventing the flow of grout up into the secondary path.

The drilling and grouting device 20 according to the disclosure has the advantage that during this grouting phase, the grout is separated from the environment with a type of 'double-protection' system. The pumping of grout through the inner rod 26 of the drill string 22 provides protection from a rupture from the inner rod 26 or from the outer rod 24. Also the drilling spoils are 'double-protected' from the environment during the drilling phase of the operation, which might be important in situations where the system might drill through contaminants. Also, because the torque is transferred from the drill head directly and only to the outer rod 24 (that is, to the succession of outer tubes forming the outer rod), the risk that the inner rod 26 breaks is reduced.

Once grouting has been completed between the depths D1 and D2, the drilling and grouting device 20 is lowered again to the bottom of the grouted layer (here, depth D2), and drilling is started again down to a depth D3.

The drilling and grouting steps are then repeated until the bottom of the desired grouting area is reached.

The device is finally removed from the ground as shown as step S5 on FIG. 10.

Figure 8:
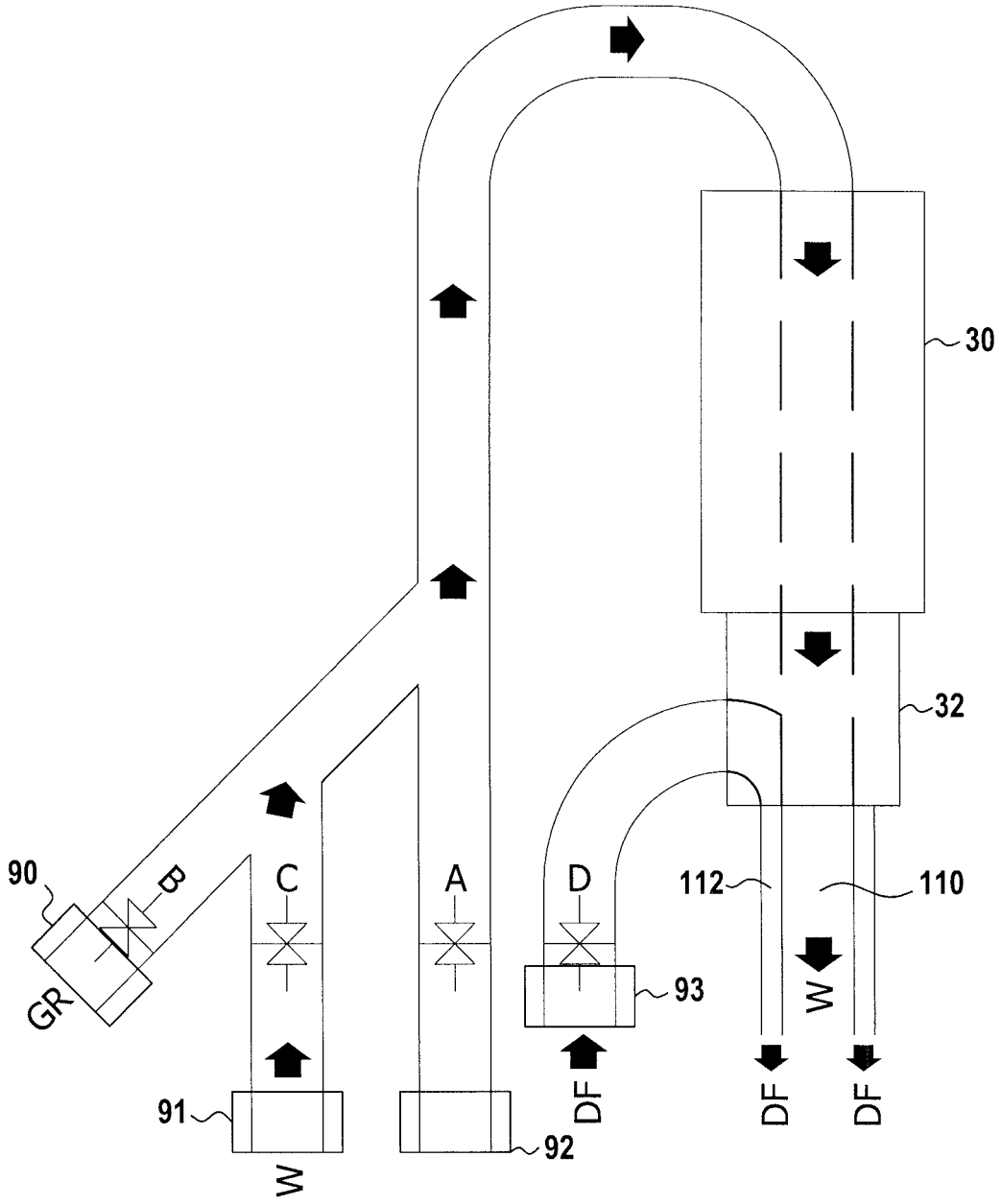
FIG. 8 is a schematic flow diagram during a drilling phase, in a case where the ground is very permeable and the drilling fluid is mainly lost therein.

In a particular embodiment illustrated in FIG. 8, when the ground to is very permeable, the drilling fluid is lost therein and cannot push the cuttings back to the surface. In order to avoid that the cuttings start moving upwards and get stuck inside the device, it is preferable that the cuttings be prevented from entering the device. With this aim, during the drilling step, water may be supplied not only to the secondary path, but also to the main path, by the water supplying device 91.

The embodiment described hereabove is not limitative of the present disclosure.

Figure 3:
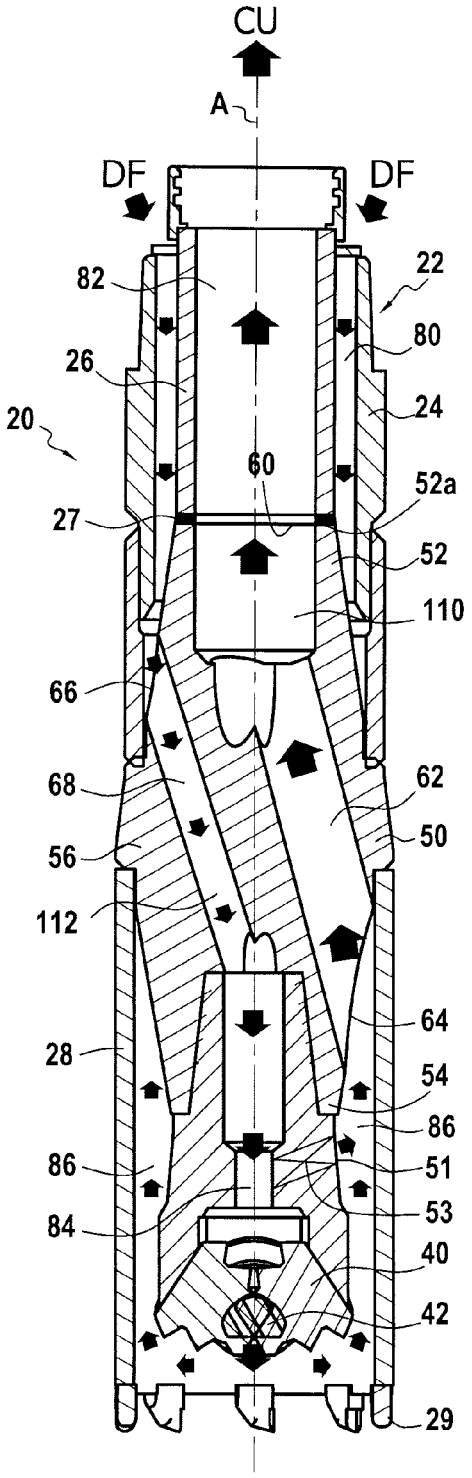
FIG. 3 is a schematic illustration of a drilling and grouting device according to embodiments of the present disclosure.

FIG. 3 shows another device according to embodiments of the disclosure.

This device comprises a bypass 51 between the secondary path 112 and the second outer flow path 86 for deviating a part of the fluid circulating through said secondary path 112 towards said second outer flow path 86.

In the illustrated example, the bypass 51 is arranged to connect the secondary connecting duct with the second outer flow path 86. Such bypass 51 enables that sufficient water be provided to the cuttings, notably in case of moderate permeable ground, when part of the drilling fluid is lost in the ground. It may advantageously be provided with a check valve 53 to avoid return of the drilling fluid into the crossover part 50.

Preferably, the bypass passage angles upwards (in the upstream direction), otherwise the flow of drilling fluid may conflict with the circulation of the cuttings that should be flowing 'up'. In such case, drilling fluid may advantageously comprise drilling water and added compressed air.

Figure 4:
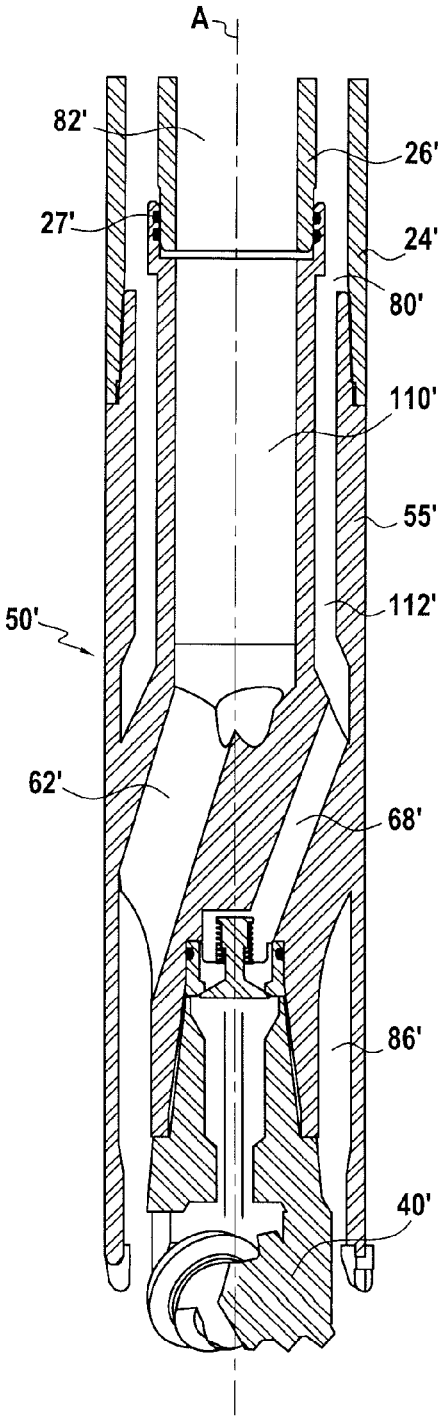
FIG. 4 shows still another device according to embodiments of the present disclosure.

FIG. 4 shows another device according to embodiments of the disclosure.

In this device, the crossover part 50' and the outer casing are in one single piece. The crossover part 50' comprises an outer casing part 55 that is threaded to the end of the outer rod 24'.

Figure 11:
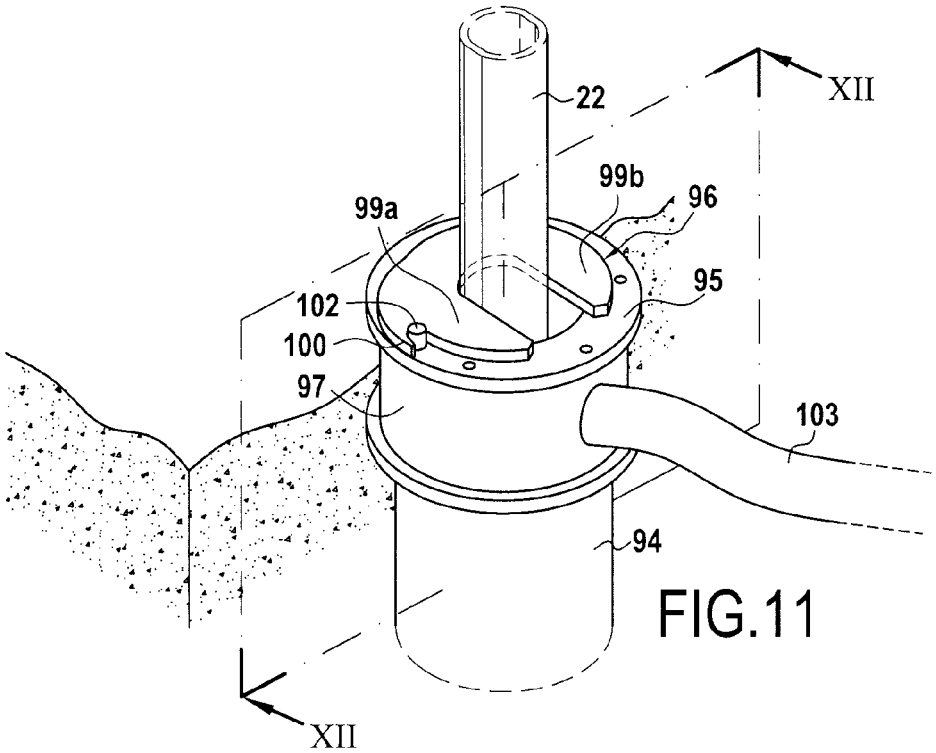
FIG. 11 illustrates an embodiment of the disclosure, particularly adapted for drilling on water sites.
Figure 13:
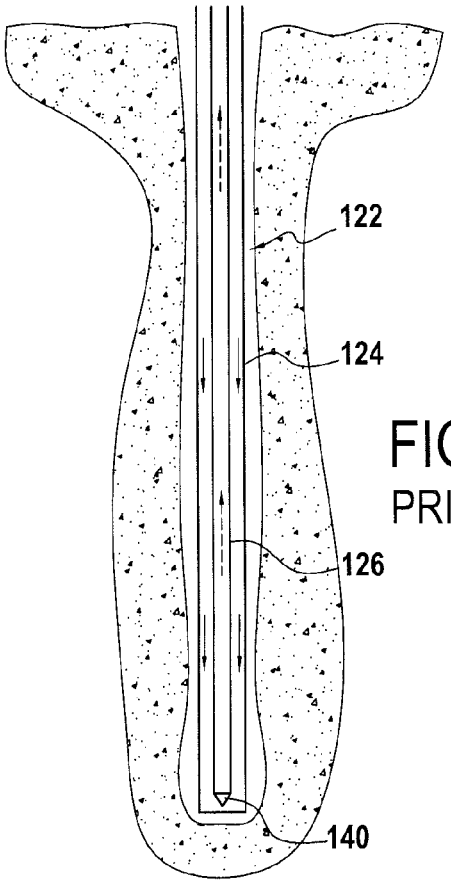
FIG.13 PRIOR ART
FIG. 13 illustrates a drilling device known from the prior art.

In some cases, the ground to be improved is under water. In such over-water drilling applications, a tertiary isolation/protection system may be used as shown in FIG. 11. This protection system may comprise an oversized protection casing 94 that is drilled into the sea-floor, for example 1-2-m.

This protection casing or tertiary containment pipe 94 surrounds the drill-string 22 and is fitted at its upper end with a diverter-head 97 for capturing any spoils or grout that may have migrated around the outside of the drill-string, and up into the water. The diverter-head 97 may be sealed around the drill-string 22 using a conventional rubber seal 98. It may be further connected to an evacuation pipe 103, for evacuating the spoils (see FIG. 11).

The protection casing 94 may be installed using a clamping system 96 as illustrated in FIG. 11.

The clamping system comprises a U-shaped clamping part 96, each leg 99*a*, 99*b* thereof having a planar contact surface adapted to come into contact with a flat outer surface of the outer rod 24 of the drill string. In the illustrated example, both planar surfaces are parallel and opposed to each other.

The clamping part 96 further comprises a protrusion 100 extending from one of its legs 99*a*, forming a stopper.

As shown in FIG. 11, a bolt-flange 95 is connected to the upper end of the diverter-head 97. A lug 102 protrudes from the upper face of said blot-flange 95.

The clamping part 96 is adapted to be disposed on the bolt-flange 95 in such a manner that the stopper 100 cooperates with said lug 102. Thereby, once the drill string 22 is introduced between the legs 99*a*, 99*b* of the clamping part 96, the rotary movement of the drill string 22 is transferred, through the clamping part 96, to the bolt-flange 95 and therefore also to the diverter head 97 and to the protection casing 94.

Figure 12A:
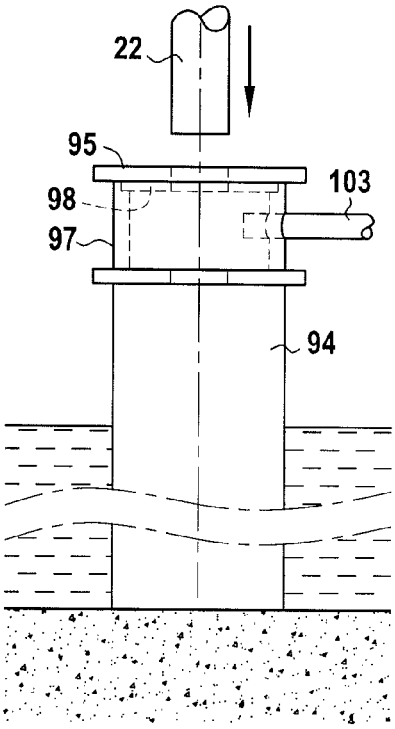
FIGS. 12A to 12C illustrate the positioning of the protection casing shown in FIG. 11.
Figure 12B:
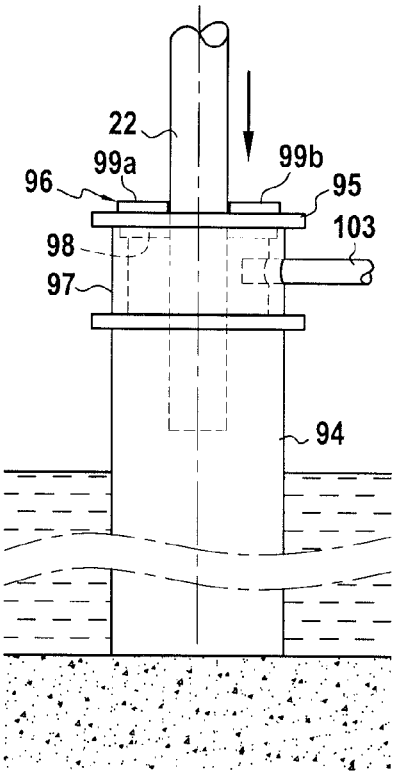
Figure 12C:
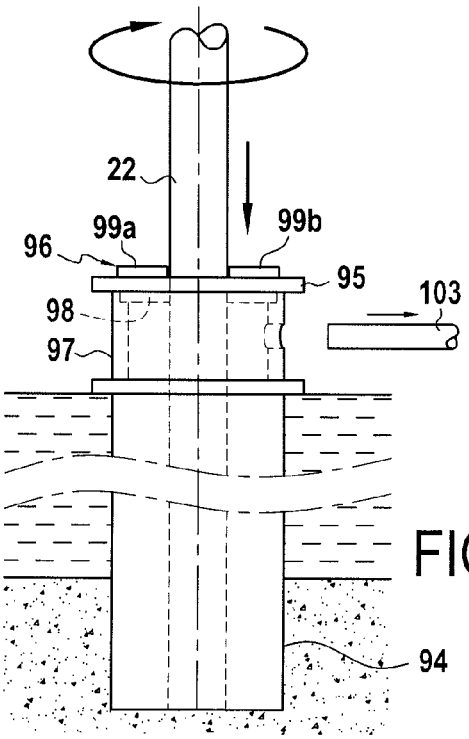

FIGS. 12A to 12C schematically illustrate how this protection casing is set up.

As illustrated in FIG. 12A, the protection casing 94 is firstly introduced in the water down to the sea bottom. The diverter head 97 is, at this point, disposed a few meters above the sea level.

The drilling and grouting device is then introduced, in part, inside the protection casing (FIG. 12B). The clamping device 96 is disposed on the bolt-flange 95, the evacuation pipe 103 is disconnected from the diverter head 97 and the drill head 18 is rotated and moved downwards along the mast 14 (FIG. 12C).

Due to the clamping device, the protection casing 94 is so to say "drilled" into the sea-floor. In order to better penetrate the see floor, the protection casing 94 is preferably supplied with cutting teeth welded to its lower end (not shown).

Throughout the description, including the claims, the term "comprising a" should be understood as being synonymous with "comprising at least one" unless otherwise stated. In addition, any range set forth in the description, including the claims should be understood as including its end value(s) unless otherwise stated. Specific values for described elements should be understood to be within accepted manufacturing or industry tolerances known to one of skill in the art, and any use of the terms "substantially" and/or "approximately" and/or "generally" should be understood to mean falling within such accepted tolerances.

Where any standards of national, international, or other standards body are referenced (e.g., ISO, etc.), such references are intended to refer to the standard as defined by the national or international standards body as of the priority date of the present specification. Any subsequent substantive changes to such standards are not intended to modify the scope and/or definitions of the present disclosure and/or claims.

Although the present disclosure herein has been described with reference to particular embodiments, it is to be understood that these embodiments are merely illustrative of the principles and applications of the present disclosure.

The invention claimed is:

1. A drilling and grouting machine, comprising:

a drilling and grouting device comprising:

a drill string having a hollow elongate outer rod having a central axis and a hollow elongate inner rod located coaxially within said outer rod, wherein a first outer flow path is defined between said inner rod and said outer rod, and a first central flow path is defined inside said inner rod, a drill bit aligned with said inner rod along said central axis and including a second central flow path with a check valve, and a crossover part interposed between said inner rod and said drill bit along said central axis, said crossover part being configured to connect the first central flow path with a second outer flow path surrounding the drill bit to form a main path and to connect said first outer flow path with said second central flow path to form a secondary path;

a first moving device for rotating said drilling and grouting device about its central axis;

a second moving device for vertically moving said drilling and grouting device in a direction parallel to the central axis;

a drilling fluid supplying device, connected to the first outer flow path through a valve of the drilling fluid supplying device, for pumping down drilling fluid through the secondary path;

a grout supplying device, connected to the first central flow path through a valve of the grout supplying device, for pumping down grout through the main path; and a discharge device, connected to the first central flow path through a valve of the discharge device, for collecting drill cuttings moving upward through the main path; and a water supplying device, connected to the first central flow path through a valve of the water supplying device, for flushing the main path.

2. The drilling and grouting machine according to claim 1, wherein the crossover part comprises:

at least one main connecting duct for connecting the first central flow path with the second outer flow path; and at least one secondary connecting duct for connecting the first outer flow path with the second central flow path.

3. The drilling and grouting machine according to claim 1, wherein the crossover part comprises at least two main connecting ducts, regularly distributed circumferentially.

4. The drilling and grouting machine according to claim 1, wherein the crossover part comprises at least two secondary connecting ducts, regularly distributed circumferentially.

5. The drilling and grouting machine according to claim 1, wherein the crossover part and the hollow elongate outer rod are adapted to rotate as a single unit.

6. The drilling and grouting machine according to claim 1, wherein a bypass is provided between the secondary path and the second outer flow path for deviating part of a fluid circulating through the secondary path towards the second outer flow path, bypassing the drill bit.

7. The drilling and grouting device according to claim 6, wherein said bypass is provided with a check valve.

8. The drilling and grouting device according to claim 6, wherein the bypass is an upwardly inclined bypass passage.

9. A drilling and grouting method, comprising the steps of:

providing a drilling and grouting machine comprising:

a drilling and grouting device comprising:

a drill string having a hollow elongate outer rod having a central axis and a hollow elongate inner rod located coaxially within said outer rod, wherein a first outer flow path is defined between said inner rod and said outer rod, and a first central flow path is defined inside said inner rod, a drill bit aligned with said inner rod along said central axis and including a second central flow path with a check valve, and a crossover part interposed between said inner rod and said drill bit along said central axis, said crossover part being configured to connect the first central flow path with a second outer flow path surrounding the drill bit to form a main path and to connect said first outer flow path with said second central flow path to form a secondary path;

a first moving device for rotating said drilling and grouting device about its central axis;

a second moving device for vertically moving said drilling and grouting device in a direction parallel to the central axis;

a drilling fluid supplying device, connected to the first outer flow path through a valve of the drilling fluid supplying device, for pumping down drilling fluid through the secondary path;

a grout supplying device, connected to the first central flow path through a valve of the grout supplying device, for pumping down grout through the main path; and a discharge device, connected to the first central flow path through a valve of the discharge device, for collecting drill cuttings moving upward through the main path;

rotating the drilling and grouting device about its central axis, moving the drilling and grouting device, as the drilling and grouting device rotates, into the ground, controlling the drilling fluid supplying device, by opening the valve of the drilling fluid supplying device, to pump down drilling fluid through the secondary path, controlling the discharge device, by opening the valve of the discharge device, to collect drill cuttings moved upwards through the main path, and controlling the grout supplying device, by opening the valve of the grout supplying device after closing the valve of the drilling fluid supplying device and the valve of the discharge device, to pump down grout through the main path, injecting the grout into the ground, while the check valve of the second central flow path prevents a flow of the grout up into the secondary path.

10. The drilling and grouting method of claim 9, further comprising injecting drilling fluid both through the main and the secondary paths during drilling.

11. The drilling and grouting method of claim 9, further comprising:

bypassing the drill bit with part of the drilling fluid supplied to the secondary path by the drilling fluid supplying device, wherein the part of the drilling fluid that bypasses the drill is deviated from the secondary path to the second outer flow path.

12. The drilling and grouting method of claim 9, further comprising:

controlling a water supplying device, by opening a valve of the water supplying device after closing the valve of the drilling fluid device and before opening the valve of the grout supplying device, to flush the main path.

* * * * *